US011339028B2

(12) United States Patent
Kirsch et al.

(10) Patent No.: US 11,339,028 B2
(45) Date of Patent: May 24, 2022

(54) SYNCHRONISATION OF DOOR MOVEMENTS IN A LIFT SYSTEM

(71) Applicant: TK Elevator Innovation and Operations GmbH, Dusseldorf (DE)

(72) Inventors: Michael Kirsch, Kirchheim unter Teck (DE); Matthias Glück, Hochdorf (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 138 days.

(21) Appl. No.: 16/753,194

(22) PCT Filed: Oct. 25, 2018

(86) PCT No.: PCT/EP2018/079280
§ 371 (c)(1),
(2) Date: Apr. 2, 2020

(87) PCT Pub. No.: WO2019/081639
PCT Pub. Date: May 2, 2019

(65) Prior Publication Data

US 2020/0247645 A1 Aug. 6, 2020

(30) Foreign Application Priority Data

Oct. 27, 2017 (DE) ..... 10 2017 219 403.0

(51) Int. Cl.
*B66B 13/12* (2006.01)
*B66B 5/00* (2006.01)

(52) U.S. Cl.
CPC ..... *B66B 13/125* (2013.01); *B66B 5/0006* (2013.01)

(58) Field of Classification Search
CPC ... B66B 13/125; B66B 5/0006; B66B 13/165; B66B 1/3492
See application file for complete search history.

(56) References Cited

U.S. PATENT DOCUMENTS 5,135,081 A * 8/1992 Watt ..... B66B 1/3492 187/394
5,360,085 A * 11/1994 Yoo ..... B66B 1/3492 187/394
5,627,439 A * 5/1997 Gregory ..... B66B 13/26 187/392
6,206,143 B1 * 3/2001 Kammura ..... B66B 1/50 187/291

(Continued)

FOREIGN PATENT DOCUMENTS

DE 196 25 193 C 12/1997
EP 1 418 149 A 5/2004

(Continued)

OTHER PUBLICATIONS

English Translation of International Search Report issued in PCT/EP2018/079280, dated Jan. 29, 2019.

(Continued)

*Primary Examiner* — Jeffrey Donels
(74) *Attorney, Agent, or Firm* — William J. Cassin

(57) ABSTRACT

A method can be used to position a car door and a landing-stop door in a synchronized manner at a landing stop in an elevator shaft of an elevator system. The car door may be configured as a guide door, and the landing-stop door may be configured as a follower door. The method may involve bringing an elevator car close to the landing stop, upon entry of the car door into an unlock zone sensing a presence signal of the follower door by way of a presence sensor of the guide door, actuating the guide-door drive by way of the guide controller and executing an opening movement of the guide door, providing movement information of the guide door, and actuating the follower-door drive of the follower door.

11 Claims, 4 Drawing Sheets

(56) References Cited

U.S. PATENT DOCUMENTS

| | | | | |
|---|---|---|---|---|
| 9,695,015 | B1 * | 7/2017 | Marinelli | B66B 13/185 |
| 2008/0000272 | A1 | 1/2008 | Park et al. | |
| 2008/0271955 | A1 * | 11/2008 | Lelic | B66B 13/22 187/313 |
| 2014/0216856 | A1 * | 8/2014 | Hovi | B66B 5/005 187/314 |
| 2018/0134521 | A1 * | 5/2018 | Beauchaud | B66B 1/28 |
| 2019/0062104 | A1 * | 2/2019 | Ahsaine | H02P 25/06 |
| 2019/0063128 | A1 * | 2/2019 | McLeod | E05C 19/166 |

FOREIGN PATENT DOCUMENTS

| | | | |
|---|---|---|---|
| EP | 2 298 684 | A | 3/2011 |
| EP | 2 607 284 | A | 6/2013 |
| EP | 3 398 899 | A | 11/2018 |
| JP | 10-316334 | | 12/1998 |
| JP | 2011121750 | A | 6/2011 |
| WO | 1997/049594 | A | 12/1997 |
| WO | 2012/045606 | A | 4/2012 |

OTHER PUBLICATIONS

1st Office Action, dated Oct. 13, 2021, in counterpart CN Application No. CN 201880069582.5, citing the above identified references that have not yet been listed in a prior Information Disclosure Statement in the present US Application. No English translation is available, but the cited references are listed using WIPO Country codes and standard Arabic numerals for the publication numbers.

* cited by examiner a)

b)

SYNCHRONISATION OF DOOR MOVEMENTS IN A LIFT SYSTEM

CROSS REFERENCE TO RELATED APPLICATIONS

This application is a U.S. National Stage Entry of International Patent Application Serial Number PCT/EP2018/079280, filed Oct. 25, 2018, which claims priority to German Patent Application No. DE 10 2017 219 403.0, filed Oct. 27, 2017, the entire contents of both of which are incorporated herein by reference.

FIELD

The present disclosure generally relates to elevators, including guide doors for elevator systems.

BACKGROUND

In the case of older passenger elevators and still in the case of freight elevators, designs can still be found in which the elevator car itself does not have a door, such that the wall of the elevator car on the landing-stop side remains free and goes directly past the shaft wall during travel. In order to reduce the resulting risk of injury, it has long been common practice in passenger elevator systems to equip both the elevator car(s) and the landing stops with separate doors for the boarding and alighting of passengers.

At the landing stop, however, the corresponding doors on the elevator car and at the landing stop must form a unit, insofar as they execute an at least substantially common opening and closing movement. Conventionally, in this case only one of the doors—the guide door—is driven; often, the car door is the guide door. The other door—then referred to as the follower door—is moved concomitantly via a mechanical coupling, the so-called cam; the landing-stop door is often realized as the follower door.

The mechanical coupling by means of the cam on one of the doors and a cam receiver on the other door has some disadvantages: for example, as the car enters the landing stop, the rollers of the cam receiver touch the cam, causing noise. In addition, the necessary alignment of the cam with the cam receiver (for example, so that the receiver does not collide with the front face of the cam) limits the relative movement of the elevator car in relation to the elevator shaft. This results in a more complex, closely toleranced guiding of the elevator car in the shaft. The alternative, of a positioning drive for the cam, is also complex.

A further disadvantage of the mechanical coupling by means of a cam and cam receiver is evident in the case of a new type of elevator system, such as that described, for example, in WO 2012/045606. This type of elevator system uses a linear motor to drive the elevator cars inside the elevator shaft. On the one hand, this type of drive makes it possible to move several cars in the same shaft, independently of each other, at the same time. On the other hand, this type of drive can be used to create an elevator system having a plurality of intersecting elevator shafts, such that an elevator car can be moved, for example, both vertically and horizontally (or diagonally, or obliquely).

In the case of operation of an elevator car along differing shaft axes, the use of mechanical coupling by means of a cam and cam receiver reaches its limitations, in particular because the door opening is no longer necessarily perpendicular to the direction of travel of the car, but for example in the case of horizontal travel may be provided parallel to it.

In some cases—for example, for inclined elevators—combinations of landing-stop doors and car doors were therefore installed, in which both doors have their own drive to open and close the respective door.

In the case of separate drives, however, it is difficult to open and close the landing-stop door and the car door with a high degree of synchronism, as required, since both drives normally have separate controllers.

Thus a need exists for improved synchronization of the opening and closing movements of doors of an elevator system. Likewise, a need exists for an improved guide door and an improved follower door, as well as an improved elevator system and an improved method for the synchronized opening and/or closing of a car door and a landing-stop door of an elevator system.

DETAILED DESCRIPTION

Figure 1:
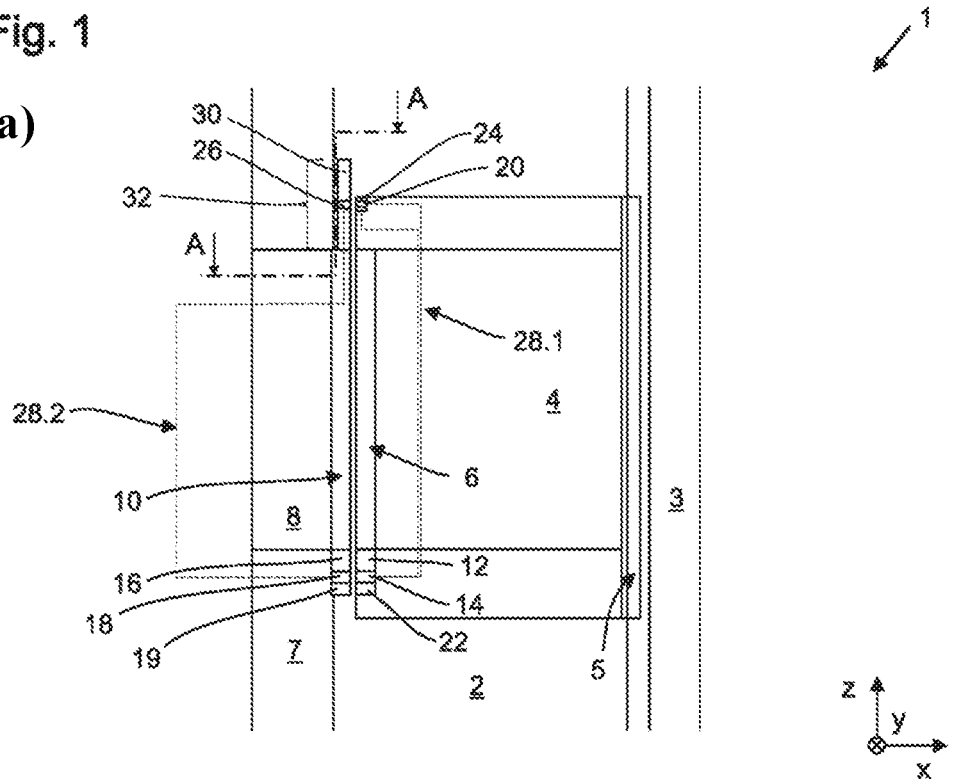
FIG. 1 is a schematic side view (FIG. 1*a*) and corresponding top view (FIG. 1*b*) along the section line A-A of a portion of an elevator shaft of an example elevator system.
Figure 1:
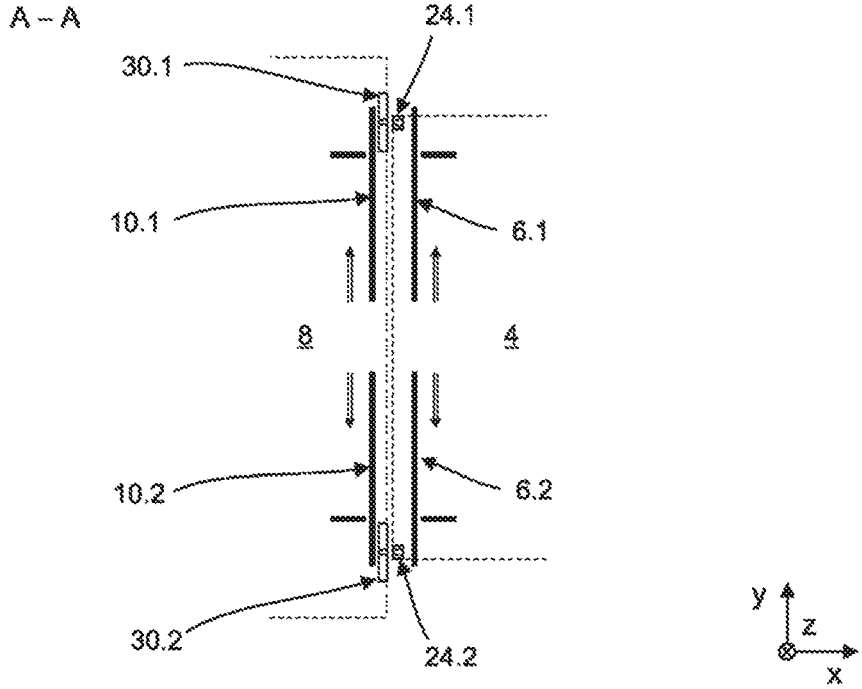

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to a guide door for an elevator system, a follower door for an elevator system, an elevator system having at least one such guide door and at least one such follower door, and to a method for synchronized opening and/or closing of a car door and of a landing-stop door of an elevator system.

According to one aspect of the invention, a guide door for an elevator system is provided. The guide door has: a) a guide-door drive, having a guide controller, which (drive and controller) are configured to move, in particular to open and/or close, the guide door at a landing stop of the elevator system, and b) a presence sensor for sensing a presence signal of a follower door within an unlock zone, preferably with respect to a relative arrangement of the guide door and the follower door in relation to each other.

The guide controller in this case is configured, in particular, in the case of a sensed presence of a follower door in the unlock zone, to interrupt a physical and/or controller-based unlock blocking of the guide-door drive, and/or to identify a landing-stop entry, and/or to actuate a movement of the guide door.

The guide door additionally has: (c) a guide drive coupling, which is configured, in the case of a landing-stop entry being identified, to provide the follower door with movement information regarding a movement of the guide door, in particular to a follower controller and/or a follower-door drive of the follower door. Provision in this case means, in particular, active transmission of the information, possibly coded, for example in the form of control commands, and/or passive indication of a detectable signal.

According to a further aspect of the invention, a follower door for an elevator system is provided. The follower door has: a) a follower-door drive, having a follower controller that is configured to move the follower door at a landing stop of the elevator system, b) a presence signaling device for providing a presence signal to a presence sensor of a guide door within an unlock zone, regarding a relative arrangement of the guide door and the follower door in relation to each other, and c) a follower drive coupling, which is configured to sense movement information of the guide door, in particular of the guide drive coupling, and/or to transmit the sensed movement information to the follower-door drive, in particular to the follower controller. Sensing in this case is to be understood to mean, in particular, receiving (preferably also further processing and/or forwarding) actively and/or passively provided movement information.

According to a further aspect of the invention, an elevator system is provided that has at least one, in particular at least two vertical elevator shafts and at least one horizontal elevator shaft. The elevator system has: a) at least one elevator car, having at least one car door, for travelling (i.e. moving) in the elevator shaft, and b) at least two landing stops that are spaced apart from each other and that each have at least one landing-stop door, for loading and unloading the elevator cars, and landing stops may be provided in a horizontal elevator shaft, in a vertical elevator shaft, in a diagonal elevator shaft and/or at an interface between two elevator shafts.

According to one embodiment, the car door is realized as a guide door according to the corresponding aspect of the invention, and the landing-stop doors are realized as follower doors according to the corresponding aspect of the invention. According to another embodiment, the car door is realized as a follower door according to the corresponding aspect of the invention, and the landing-stop doors are realized as guide doors according to the corresponding aspect of the invention.

Provided according to a further aspect of the invention is a method for moving in a synchronized manner (i.e. for positioning in a synchronized manner), in particular for opening and/or closing in a synchronized manner, a car door of an elevator car and a landing-stop door at a landing stop in at least one elevator shaft of an elevator system. The car door in this case is preferably realized as a guide door, and the landing-stop door realized as a follower door, or vice versa.

The method comprises the steps: i) bringing the elevator car close to the landing stop, ii) upon entry of the car door into an unlock zone, sensing a presence signal of the follower door, in particular by means of a presence sensor of the guide door, and identifying a landing-stop entry, iii) actuating, in particular an opening positioning profile, of the guide-door drive by means of the guide controller, and executing the (opening) movement of the guide door, in particular according to the opening positioning profile, iv) providing movement information of the guide door, in particular by means of the guide drive coupling, and/or in particular according to the opening positioning profile, v) sensing of the provided movement information by the follower door, in particular by means of the follower drive coupling, vi) actuating the follower-door drive of the follower door in dependence on the sensed movement information of the guide door, in particular in order to achieve an opening of the guide door and of the follower door that is synchronized with the guide door.

According to one embodiment, the doors may be closed in a synchronized manner, in that the steps iii) to vi) described above are executed, in a manner analogous to that described above, with respect to a closing positioning profile of the guide door.

The invention is based, inter alia, on the knowledge that the mechanical coupling of the car door and the landing-stop door by means of a cam on one door and a cam receiver on the other door includes a plurality of functionalities:

Firstly, as a result of the cam being received in the cam receiver, the presence of the cars at the landing stop, or a sufficient overlap of the opening regions of the two doors for safe opening of the door, can be ensured in a reliable manner. Secondly, the coupling of the cam and receiver serves to interrupt an unlock blocking of the coupled doors. Thirdly, if the mutual contact surfaces of the cam and the cam receiver are suitably designed, a driver function can be realized, which allows synchronized opening and/or closing of the two doors even if only one of the doors is driven.

These functionalities (ensuring sufficient overlap of the two doors, unlocking and synchronizing the movements of the doors) must be achieved even if, for the reasons mentioned at the beginning, mechanical coupling of the doors does not seem appropriate and the two doors are therefore driven separately.

The invention is thus based on the concept, inter alia, of improving the synchronization of the two doors by means of a master-slave relationship with respect to the two doors: the guide door in this case assumes the 'master' functions, and the follower door assumes the 'slave' functions. More precisely, as the car is travelling in the elevator shaft, the guide door, using an appropriate sensor technology for identifying the follower door, monitors that side of its door on which—moved relative thereto—an approach of the follower door is to be expected.

When the follower door and the guide door enter their common unlock zone, the guide controller identifies a landing-stop entry and, at an appropriate time point before, upon or after attainment of standstill of the two doors in relation to each other, actuates opening of the guide door. In addition, movement information regarding the movement of the guide door is provided in real time to the follower controller of the follower door. This can be done by active transmission or by passive provision of a detectable signal, with the follower door, for its part, having suitable sensor technology for sensing the movement information. Depending on the information received, the follower controller can then actuate the follower-door drive in real time in such a manner that the guide door and the follower door execute a synchronized movement.

Such a, preferably bidirectional, sensor/signaling device coupling between the guide door and the follower door makes it possible to replace the complicated, high-maintenance, error-prone mechanical coupling, while still ensuring a sufficient overlap between the two doors when they open, as well as good synchronization of the movements of the doors.

In addition, in the case of the elevator type described at the beginning, having a plurality of intersecting elevator shafts, it becomes possible to achieve coupling of the doors when landing stops are approached in a plurality of directions of movement with respect to differing longitudinal axes of the shaft, as would at most be conceivable, with a mechanical coupling, only with an undesirably complex mechanism.

A further advantage is obtained if, according to one embodiment, the unlock zone is dimensioned more extensively, possibly also in respect of a plurality axes of movement. This is conceivable, for example, through a suitable combination of presence sensor of a guide door and presence signaling device on the follower door. An unlock zone of, for example, just under half a meter around the entire overlap of the two doors in relation to each other can then be achieved, for example in respect of two right-angled axes of movement, each having opposite directions of movement. This allows the elevator car to enter the landing stop with the doors already opening, which in turn allows faster operation of the elevator system and thus increases the time-based transportation capacity.

According to one embodiment, in order to achieve a particularly reliable way of synchronizing the movement of the two doors, the guide drive coupling has a transmitter, in particular an active transmitter, for providing the movement information to the follower door, and in particular is configured to actively send control commands from the guide controller to the follower door. The transmitter preferably has a suitable inductive and/or optical data transmission means.

To render possible a simple embodiment of the drive coupling, the guide drive coupling has a reference-point signaling device for providing the movement information to the follower door, and in particular is configured to provide a position signal that can be read by the follower door. The reference-point signaling device preferably has a suitable signal source, which for example may be similar or identical in design to the presence signaling device of the follower door.

To enable the movement of the two doors to be synchronized by means of a closed-loop control circuit, the guide drive coupling is configured to receive status data of the follower door, in particular of the follower-door drive, from the follower door, in particular from the follower drive coupling, and in particular to forward this data to the guide controller.

The presence sensor may be realized in a variety of ways, and use different detection principles in different embodiments. In particular, the presence sensor may have I) at least one optical sensor for reading a code band, which represents a simple and cost-effective solution. However, the presence sensor may also have II) an active RFID element for sensing a passive RFID element, which enables the size of the unlock zone to be adapted by adjustment of the sensing power. If the presence sensor III) has an electromagnetic coil for sensing a metal plate, the size of the metal plate preferably defines the size of the unlock zone. Analogously, this also applies to a presence sensor having IV) a Hall sensor for sensing a magnetized iron plate or a magnet or a field of distributed magnets. A very precise solution is also provided by a presence sensor having V) a laser interferometer for identifying a laser reflector, as well as a presence sensor having VI) an ultrasonic source/sensor for identifying an ultrasonic reflector.

In order to be able to receive the movement information of the guide door, the follower drive coupling, according to one embodiment, has a receiver for sensing movement information of the guide door. The receiver is preferably configured to receive, as movement information, control commands from a transmitter of the guide door and/or position signals from a reference-point signaling device of the guide door. The receiver preferably has a suitable receiving sensor, which for example may be similar or identical in design to the presence sensor of the follower door.

To enable the movement of the two doors to be synchronized by means of a closed-loop control circuit, the follower drive coupling is configured to transmit status data of the follower door to the guide door, in particular to the guide drive coupling.

The presence signaling device may be realized in a variety of ways, the signal used preferably being based on the detection principle of the presence sensor. In particular, the presence signaling device may comprise at least: I) a code band, II) a passive RFID element, III) a metal plate, IV) a magnetized iron plate or another magnet or a field of distributed magnets, V) a laser reflector, and/or VI) an ultrasonic reflector. The use of corresponding Roman numerals for possible designs of the presence sensor and of the presence signaling device is intended, in the context of the invention, to indicate advantageous combinations of presence sensor and presence signaling device.

In order that opening of the synchronized doors can begin as soon as the car enters the landing stop, according to one embodiment the elevator system is configured to open and/or close the car door and landing-stop door in a synchronized manner within the unlock zone.

Preferably, the unlock zone extends along a relative overlap of the two doors (along the travel axis of the elevator car) of at least 90%, in particular of at least 85%, 80% or 75%. The follower door is thus in the unlock zone as soon as a relative overlap of both doors (along the travel axis of the elevator car) of at least 90%, in particular of at least 85%, 80% or 75%, is attained. In the case of typical opening areas of elevator doors, for example, the unlock zone may extend at least 25 cm, in particular at least 50 cm, for each of the two directions of travel (upwards and downwards), with respect to a vertical travel axis. With respect to a horizontal travel axis, the unlock zone may extend, for example, at least 10 cm, in particular at least 25 cm or 50 cm, for each of the two travel directions (left and right). Also, in one embodiment, unlock zones of the above-mentioned or similar sizes may be provided for inclined travel directions having a horizontal and a vertical component.

In order that the invention can also be used in conjunction with the new type of elevator systems mentioned at the beginning, according to one embodiment the elevator system has at least two elevator shafts that intersect each other, in particular at right angles or obliquely, wherein the unlock zone is designed for all directions of travel of the elevator car.

To enable the same sensor/signaling device combination to be used for the guide door and for the follower door, according to one embodiment the presence identification and the drive coupling are realized jointly for each of the doors, in particular as a sensor/signaling device combination.

In order to achieve real-time synchronization, the follower door travels at least substantially simultaneously with the guide door along a positioning profile corresponding to the opening positioning profile of the guide door.

Represented in FIG. 1 is a portion of an elevator system 1 comprising at least one elevator shaft 2. Indicated in the sectional side view is a section line A-A, along which a schematic representation is shown as a sectional top view A-A.

Arranged in the elevator shaft 2 there is at least one elevator car 4 for travelling in both directions z along the longitudinal axis Z of the elevator shaft 2. The elevator shaft 2 has a rear shaft wall 3, on which the car 4 is mounted and where a rotor, fixed to the car, and a stator, fixed to the shaft, realize a linear motor 5 for moving the elevator car 4. The elevator shaft 2 also has a front shaft wall 7, arranged in which there is a landing stop 8 for loading and unloading the elevator car 4.

The elevator car 4 has two car doors, each of the car doors being realized as a guide door 6.1 and 6.2 for a corresponding follower door 10 arranged at a landing stop 8. Each of the car doors 6 has its own guide-door drive 12, having its own guide controller 14.

In the represented portion of the elevator shaft 2, also arranged on a shaft wall is the landing stop 8 for loading and unloading the elevator car 4 when the latter comes to stop at the landing stop 8. The landing stop 8 has two landing-stop doors, each of the landing-stop doors being realized as a follower door 10 (10.1 and 10.2) for a corresponding guide door 6 arranged on an elevator car 4. Each of the landing-stop doors 10 has its own follower-door drive 16, having its own follower controller 18.

In the exemplary embodiment, the arrangement of two car doors 6 on the elevator car 4 and two landing-stop doors 10 at the landing stop 8 is effected in such a manner that the movements of a left-side car door 6.2 and a left-side landing-stop door 10.2 are to be synchronized with each other, and the movements of a right-side car door 6.1 and of a right-side landing-stop door 10.1 are to be synchronized with each other. Preferably, it is provided that the left-side doors open to the left, and the right-side doors open to the right. Owing to the symmetrical design of the two door combinations, statements about one combination of a guide door 6 with a follower door 10 also apply analogously to the other combination.

Each of the car doors realized as a guide door 6 comprises, besides the guide-door drive 12 and the guide controller 14, a presence sensor 20 for sensing a presence signal of the corresponding landing-stop door (which is realized as a follower door 10). In the exemplary embodiment, the presence sensor 20 is realized as an optical distance meter, for example comprising a laser interferometer.

Each of the guide doors 6 additionally has a guide drive coupling 22 that can provide the follower door 10 with movement information regarding a movement (see double-line arrows) of the guide door 6. In the exemplary embodiment, the guide drive coupling 22 can send the movement information to a receiver 26 of the follower door 10 by means of an active transmitter 24. In the present case, the transmitter 24 is equipped, for example, with a suitable inductive data transmission means.

The guide controller 14, in addition to the connection to the guide-door drive 12, is connected, by means of appropriate lines 28.1 (or possibly also wirelessly), to the presence sensor 20, to the guide drive coupling 22 and/or to the active transmitter 24 of the guide drive coupling 22.

Each of the landing-stop doors 10 realized as a follower door comprises, besides the follower-door drive 16 and the follower controller 18, a presence signaling device 30 for providing a presence signal to the corresponding car door (which is realized as a guide door 6). In the exemplary embodiment, the presence signaling device 30 is realized as a laser-reflecting surface in a defined distance band from the presence sensor 20. The presence signaling device 30 extends along the entire unlock zone 32, such that, in principle, an unlock blocking of the guide-door drive 12 can be interrupted as soon as a safe overlap between guide doors 6 and follower doors 10 is attained upon entry to a landing stop.

Each of the follower doors 10 additionally has a follower drive coupling 19 that can acquire movement information from the guide door 6 and transmit the acquired movement information to the follower-door drive 16. In the exemplary embodiment, the movement information may be acquired by means of a receiver 26 of the follower drive coupling 19, which can inductively read signals of a transmitter 24 of the guide door 6.

The follower controller 18, in addition to the connection to the follower-door drive 16, is connected, by means of appropriate lines 28.2 (or possibly also wirelessly), to the follower drive coupling 19, to the receiver 26 of the follower drive coupling 19 and/or to the presence signaling device 30.

The exemplary elevator system 1, having guide doors 6 and follower doors 10, in each case according to an exemplary embodiment of the invention, can be used to execute a method ('method' is used here in the sense of 'process') for the synchronized positioning ('positioning is used here in the sense of 'moving'), in particular opening and/or closing, of a car door 6 of an elevator car 4 and of a landing-stop door 10 at a landing stop 8. The functioning of the invention is explained below in greater detail on the basis of this exemplary method, the car doors each being realized as guide doors 6.1 and 6.2, and the landing-stop doors each being realized as follower doors 10.1 and 10.2.

In FIG. 1, the elevator car 4 has already come to a stop at the landing stop 8. The opening contour of the two car doors 6 and the opening contour of the two landing-stop doors 10 are thus at least substantially congruent with each other at the landing stop 8.

Before the car 4 and the landing stop 8 reached this congruent position in relation to each other, the elevator car 4 had approached the landing stop 8, as is represented, for example, in FIG. 2*a*.

During the entry of the car door 6 into the unlock zone 32, each of the car doors 6, as a guide door, had sensed the presence signal of the (relatively) approaching, corresponding landing-stop door 10, as a follower door, by means of its presence sensor 20. Such a position of the elevator car and landing stop in relation to each other is shown in FIG. 2*b*, for example. In dependence on this, and if necessary in combination with other movement information, the guide controller 14 had identified a landing stop entry.

Then, after the opening contours of the two guide doors 6, on the one hand, and of the two follower doors 10, on the other hand, have been identified as being substantially congruent, the guide controller 14 interrupts the unlock blocking of the guide-door drive 12 and actuates an opening of the guide door 6.1 assigned to it (cf. double-line arrows on the car side in the sectional representation A-A). The same applies to the other guide door 6.2. Accordingly, both guide doors 6.1 and 6.2 open according to the opening positioning profile actuated by means of the guide controller 14.

At the same time, each of the guide controllers 141, by means of its guide drive coupling 22 and an associated, preferably inductive, transmitter 24, actively provides movement information to the corresponding follower door 10, for example in the form of control commands. The corresponding follower door 10 can acquire the provided movement information by means of a, preferably inductive, receiver 26 of its follower drive coupling 19.

At least essentially in real time, the follower-door drive 16 of the corresponding follower door 10 is then actuated in dependence on the acquired movement information of the guide door 6. An opening of the follower door 10 that is synchronized with the guide door 6 can thus be achieved (cf. double-line arrows on the landing-stop side in the sectional representation A-A).

The double-line arrows in the section A-A are intended to indicate the synchronized opening of all participating doors 6.1, 6.2, 10.1 and 10.2 at the landing stop 8. In the case of a subsequent closing of the doors 6 and 10, the relevant method steps can be executed analogously.

Figure 2:
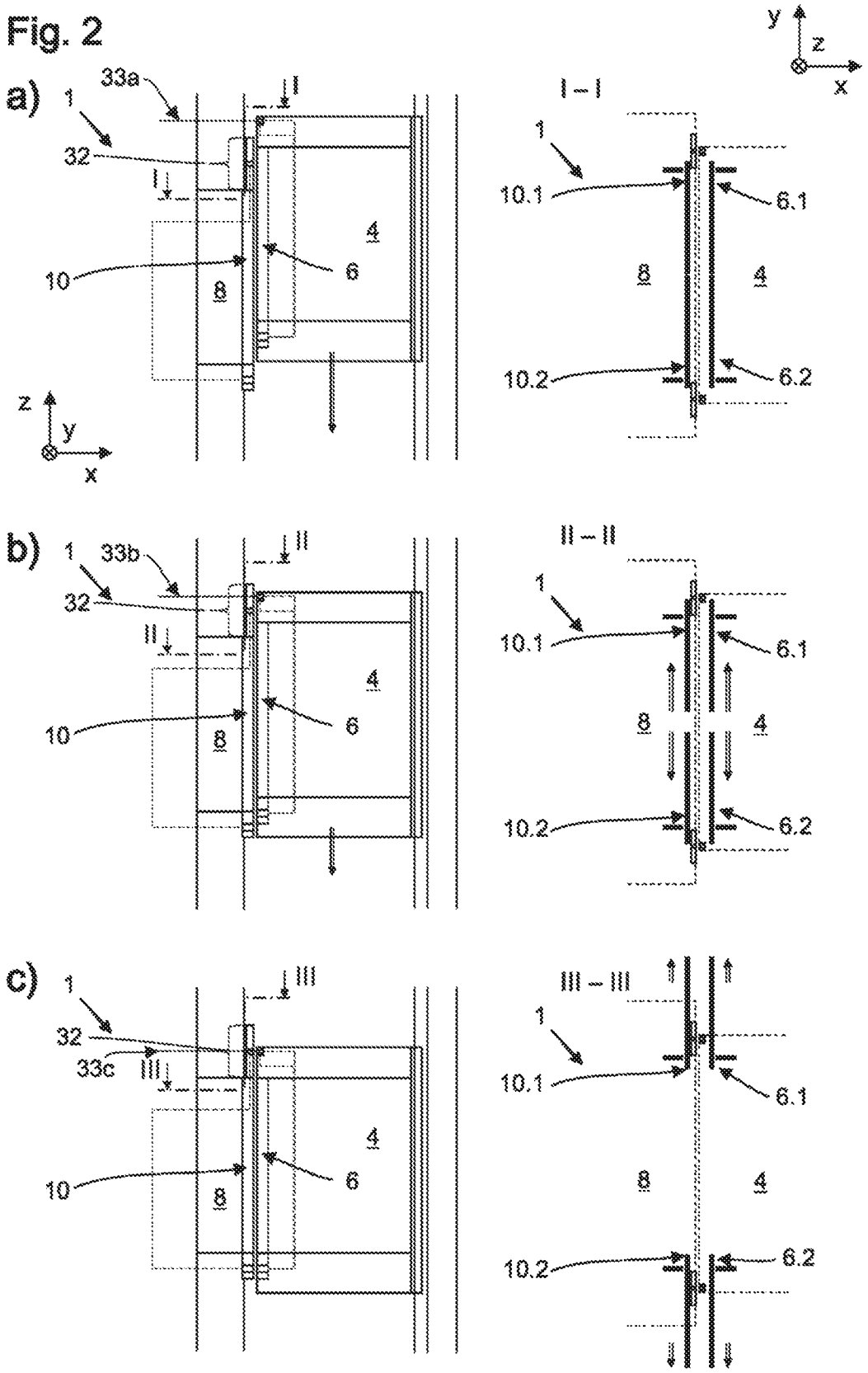
FIG. 2*a* is a side view and corresponding top view along the section line I-I of the elevator system of FIG. 1 at a first point in time while approaching of the landing stop by the elevator car.
FIG. 2*b* is a side view and corresponding top view along the section line II-II of the elevator system of FIG. 1 at a second point in time while approaching of the landing stop by the elevator car.
FIG. 2*c* is a side view and corresponding top view along the section line III-III of the elevator system of FIG. 1 at a third point in time while approaching of the landing stop by the elevator car.

FIG. 2 shows, in particular, the possibility of realizing a function for the elevator system 1 from FIG. 1 in which the door opening can already start as soon as the car doors 6 arrive within the unlock zone that is common with the landing-stop doors (also called "entry with opening doors"), during the final phase of the entry of the elevator car 4 into the landing stop.

FIG. 2*a* in this case shows the elevator car 4 outside the unlock zone 32, which is to be illustrated by the broken line 33*a* at the level of the presence sensor 20. FIG. 2*b* shows the elevator car inside the unlock zone 32 (see also broken line 33*b*), but not yet arrived at the landing stop 8. FIG. 2*c* shows the car doors 6 and the landing-stop doors 10 completely overlapping at the landing stop 8, with the elevator car 4 arrived at the landing stop. Accordingly, the broken line 33*c* has 'arrived' exactly in the middle of the unlock zone 32. A typical synchronized door opening, at the respective time point of the representation, is shown on the basis of sectional representations along the respectively indicated section lines I-I, II-II and III-III (cf. also double-line arrows in the sectional representation).

In order in this sense to implement the function of entry with opening doors, the unlock zone 32 is realized such that, already in the final phase of the approach of the elevator car 4 toward the landing stop, the unlock blocking is interrupted and the door can be opened. For this purpose, the presence signaling device 30 of the follower door 10 (see FIG. 1) is sufficiently large in each case, as in the example shown, in the present case, for example, 25 cm or 50 cm in each of the two directions of movement z along the longitudinal axis Z of the elevator shaft 2.

In an exemplary embodiment that is not represented, the sensor/signaling device pair 20 and 30 for presence identification may be realized, for example, by means of passive and active RFID elements instead of by means of laser interferometry, and the size of the unlock zone 30 (for example also in respect of a plurality of movement axes Z and Y in a plurality of elevator shafts) can then be determined from the strength of the read-out field of the active RFID element.

In the exemplary embodiment represented, the doors 6, 10, for example, may already be open to a fifth or a quarter of their full intended opening when the car arrives at its stopping position at landing stop 8. An opening that is still relatively small is shown in the section II-II of FIG. 2*b*, shortly before the landing stop is reached; the position of the open doors is shown in the section III-Ill of FIG. 2*c*.

The synchronization of the guide doors 6 with the respective follower door 10 is effected as described in relation to FIG. 1.

Figure 3:
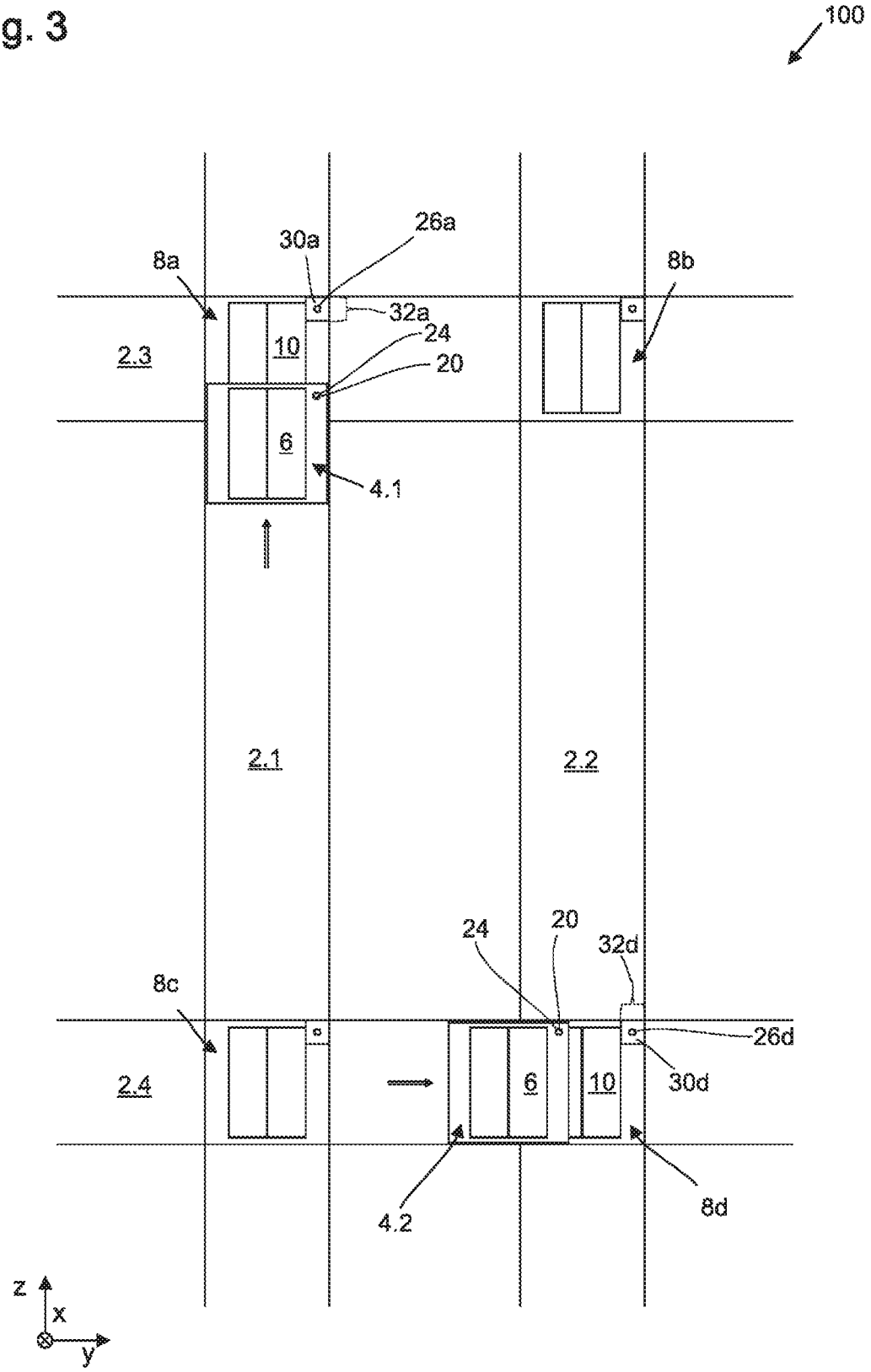
FIG. 3 is a sectional side view of a portion of another example elevator system that includes at least two horizontal shafts, at least two vertical shafts, and at least two elevator cars.

FIG. 3 shows how, according to an exemplary embodiment of the invention, it can be used even more advantageously in an elevator system 100 of the new type described at the beginning, having a plurality of mutually intersecting elevator shafts 2.1 to 2.4. This is because mechanically coupling the guide doors and the follower doors to each other becomes very difficult when landing-stop entries are intended along more than one axis Z and Y. In the exemplary embodiment shown, mutually intersecting vertical 2.1, 2.2 and horizontal 2.3, 2.4 elevator shafts are provided, the elevator cars 4.1 and 4.2 being able to move both horizontally and vertically. If the guide doors 6 on the elevator car 4 were now mechanically coupled to the follower doors 10 at the landing stops 8*a* to 8*d*, a very complex construction of a cam and cam receiver would be necessary.

In the case of horizontal movement y of the elevator cars 4, in particular, the cam would also have to enter the cam receiver along the same axis Y along which the opening of the doors would then be effected (cf. double-line horizontal arrow in the case of elevator car 4.2). Owing to use of presence identification (comprising presence sensor 20 and presence signaling device 30) and a drive coupling (comprising guide drive coupling 22 and follower drive coupling 19) as described in relation to FIG. 1, the need for a complex mechanical coupling is completely eliminated. Even the coincidence of the movement axis Y of the elevator car and the opening axis Y of the doors 6, 10 in the case of horizontal movement y of the elevator car 4.2 can be realized without additional problems—such as occur in the case of a two-axis mechanical coupling—with the method steps described in relation to FIG. 1.

All that is required for this is a sensor/signaling device pair 20 and 30 for presence identification, which renders possible an appropriately predetermined unlock zone 32 in respect of both movement axes Z and Y. FIG. 3 shows the vertical unlock zone 32*a* as an example for landing stop 8*a*, the horizontal unlock zone 32*d* as an example for landing stop 8*d*. For the technical implementation of presence identification, the technologies described in relation to FIGS. 1 and 2 may be used, for example.

Figure 4:
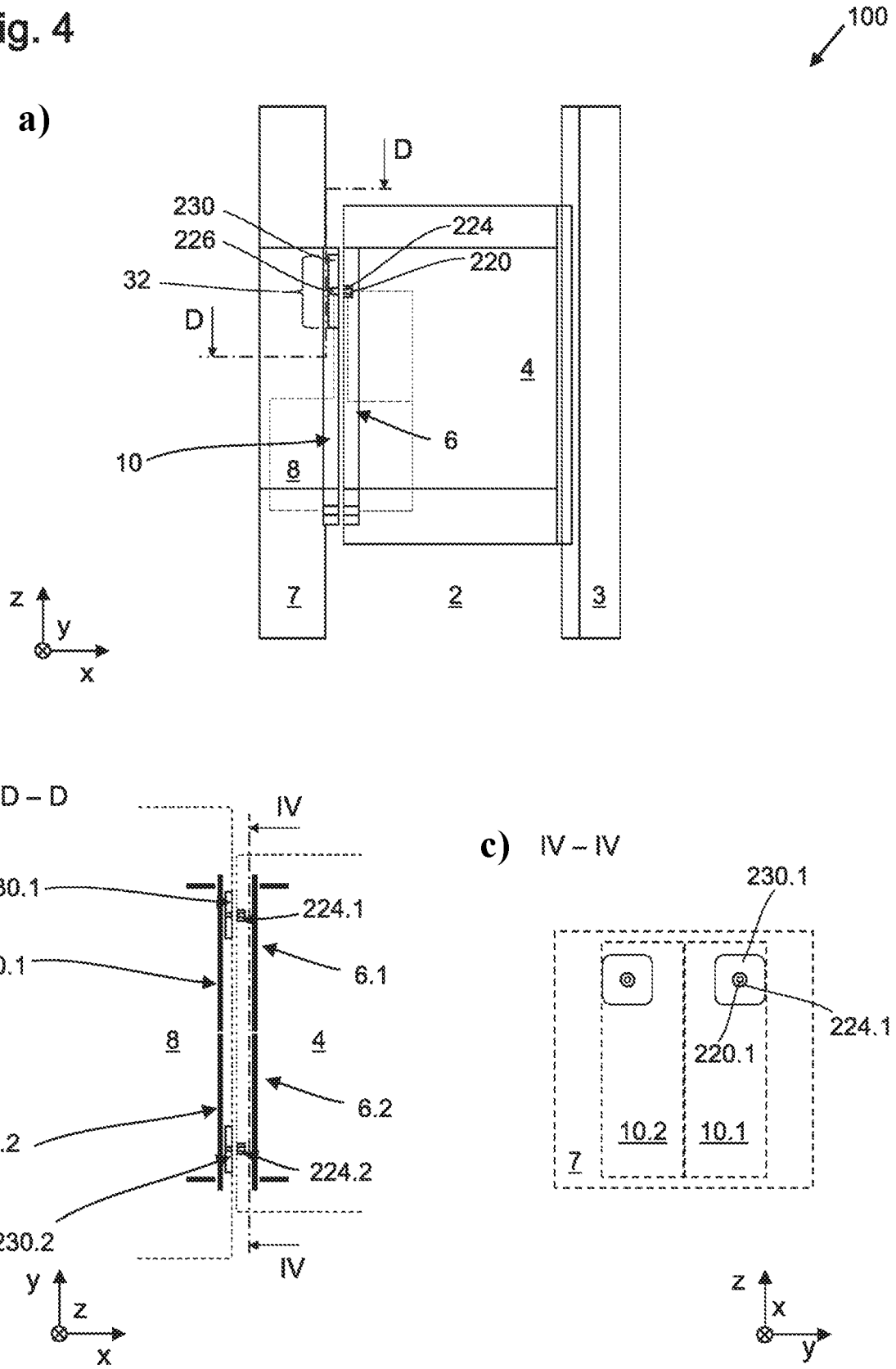
FIG. 4 is a sectional side view (FIG. 4*a*), a corresponding top view (FIG. 4*b*) along the section line D-D, and a corresponding front view (FIG. 4*c*) along the section line IV-IV of still another example elevator system.

FIG. 4 shows an elevator system 200 according to a further exemplary embodiment of the invention, in which the sensors and the signaling devices of the presence identification 220, 230, on the one hand, and the transmitters 224 and receivers 226 of the drive coupling 19, 22, on the other hand, are each arranged on the respective door, in particular on the respective door leaf, the guide door 6 and the corresponding follower door 10. FIG. 4 shows the elevator system 200 in a sectional side view, a sectional top view D-D, and in a sectional front view IV-IV.

For presence identification, the guide door 6 is equipped, for example, with an ultrasonic interferometer, which has an ultrasonic source and an ultrasonic sensor, and can thus identify on the follower door an ultrasonic reflector that delimits an unlock zone 32 in respect of all the provided directions of movement z and y.

For the purpose of drive coupling, the guide door 6 has a reference-point signaling device 224, for example in the form of a magnet, which serves as a signal source for providing the movement information of the guide door 6, and the position and direction of movement of which can be sensed by a receiver 226 of the follower drive coupling, which for this purpose preferably has a Hall sensor or other suitable magnetic detector.

This enables passive provision of the movement information by the guide door 6, such that, on the basis of the sensed movement of the reference-point signaling device 224 of the guide door 6, the follower-door drive is enabled, by means of the follower controller, to copy the movement of the guide door 6 for the corresponding follower door 10, at least substantially in real time.

LIST OF REFERENCES

1, 100, 200 elevator system
2 elevator shaft
3 rear shaft wall
4 elevator cars
5 linear motors
6 guide doors
7 front shaft wall
8 landing stop
10 follower door
12 guide-door drive
14 guide controller
16 follower-door drive
18 follower controller
19 follower drive coupling
20, 220 presence sensor
22 guide drive coupling
24 transmitter
26, 226 receiver
30, 230 presence signaling device
32 unlock zone
33 line at level of presence sensor
224 reference-point signaling device
X perpendicular to opening plane of the doors
Y horizontal parallel to opening plane of the doors
Z vertical direction

What is claimed is:

1. An elevator system comprising:
a first elevator shaft;
a second elevator shaft one of obliquely or orthogonally intersecting the first elevator shaft;
an elevator car having a car door and configured to travel in the first elevator shaft and the second elevator shaft; and
at least two landing stops that are spaced apart from one another for loading and unloading the elevator car, each of the at least two landing stops including a landing-stop door, wherein either the car door is configured as a guide door and each landing-stop door is configured as a follower door or the car door is configured as a follower door and each landing-stop door is configured as a guide door,
wherein the guide door comprises,
a guide door drive including a guide controller that is configured to move the guide door at the at least two landing stops,
a presence sensor for sensing a presence signal of the follower door within an unlock zone with respect to a relative position between the guide door and the follower door, wherein where a presence of the follower door is sensed in the unlock zone the guide controller is configured to actuate a movement of the guide door, and
a guide drive coupling configured in a case where a landing-stop entry is identified to provide the follower door with movement information regarding a movement of the guide door,
wherein the follower door comprises
a follower-door drive including a follower controller that is configured to move the follower door at the at least two landing stops,
a presence signaling device for providing the presence signal to the presence sensor of the guide door within the unlock zone regarding the relative position between the guide door and the follower door, and
a follower drive coupling that is configured to sense movement information of the guide door and to transmit the sensed movement information to the follower-door drive,
wherein the elevator system is configured to at least one of open or close the car door and the landing-stop door in a synchronized manner within the unlock zone, which unlock zone is configured to accommodate travel of the elevator car in all directions.

2. The elevator system of claim 1 wherein the unlock zone extends along a relative overlap of the follower door and the guide door of at least 90% along a travel axis of the elevator car.

3. The elevator system of claim 1 wherein presence identification and the follower drive coupling and the guide drive coupling are realized jointly for each of the guide door and the follower door.

4. The elevator system of claim 1 wherein the guide drive coupling includes a transmitter for providing the movement information to the follower door.

5. The elevator system of claim 1 wherein the guide drive coupling includes a reference-point signaling device for providing the movement information to the follower door.

6. The elevator system of claim 1 wherein the presence sensor includes at least one of:
an optical sensor for reading a code band;
an active RFID element for sensing a passive RFID element;
an electromagnetic coil for sensing a metal plate;
a Hall sensor for sensing a magnetized iron plate;
a laser interferometer for identifying a laser reflector; or
an ultrasonic source/sensor for identifying an ultrasonic reflector.

7. The elevator system of claim 1 wherein the follower drive coupling includes a receiver for sensing movement information of the guide door.

8. The elevator system of claim 7 wherein the receiver is configured to receive as movement information control commands from a transmitter of the guide door and/or position signals from a reference point signaling device of the guide door.

9. The elevator system of claim 1 wherein the presence signaling device includes at least one of:
a code band;
a passive RFID element;
a metal plate;
a magnetized iron plate;
a laser reflector; or
an ultrasonic reflector.

10. A method for positioning a car door and a landing-stop door in a synchronized manner at a landing stop in an elevator shaft of an elevator system that has a first elevator shaft and second elevator shaft that intersect each other one of obliquely or orthogonally, wherein the car door is configured as a guide door and the landing-stop door is configured as a follower door, the method comprising:

bringing an elevator car close to the landing stop so the car door moves into an unlock zone that is configured to accommodate travel of the elevator car in all directions;

upon entry of the car door into the unlock zone, sensing a presence signal emitted from the follower door by way of a presence sensor of the guide door;

actuating the guide-door drive by way of a guide controller and executing an opening movement of the guide door;

providing movement information of the guide door;

sensing the movement information by the follower door; and actuating a follower-door drive of the follower door based on the sensed movement information of the guide door.

11. The method of claim 10 wherein the follower door travels at least substantially simultaneously with the guide door along a positioning profile corresponding to an opening positioning profile of the guide door.

* * * * *